US006564393B2

(12) United States Patent
Davies

(10) Patent No.: US 6,564,393 B2
(45) Date of Patent: May 20, 2003

(54) PROTECTIVE ANKLE WEAR FOR BICYCLERS

(76) Inventor: Christopher N. Davies, 3938 W. Alabama #9, Houston, TX (US) 77027

( * ) Notice: Subject to any disclaimer, the term of this patent is extended or adjusted under 35 U.S.C. 154(b) by 0 days.

(21) Appl. No.: 09/950,180

(22) Filed: Sep. 10, 2001

(65) Prior Publication Data

US 2003/0046749 A1 Mar. 13, 2003

(51) Int. Cl.[7] ..... A41B 11/00
(52) U.S. Cl. ..... 2/239; 36/89; 602/27
(58) Field of Search ..... 2/239–242, 22, 2/227, 455, 61; 36/10, 50.1, 1.5, 126–132, 136, 89; 602/23, 27

(56) References Cited

U.S. PATENT DOCUMENTS

| | | | | |
|---|---|---|---|---|
| 2,119,602 A | | 6/1938 | Roberts et al. | 2/227 |
| 2,449,410 A | | 9/1948 | Polinsky | 54/82 |
| 3,266,058 A | | 8/1966 | Guttman | 2/239 |
| 3,995,322 A | | 12/1976 | Chesebro, Jr. | 2/239 |
| 4,099,269 A | * | 7/1978 | Porner | 2/16 |
| 4,187,619 A | * | 2/1980 | Gibbs | 2/240 |
| 4,856,110 A | | 8/1989 | Giesick | 2/22 |
| 5,133,088 A | * | 7/1992 | Dunlap | 2/239 |
| 5,307,522 A | | 5/1994 | Throneburg et al. | 2/239 |
| 5,335,517 A | | 8/1994 | Throneburg et al. | 66/185 |
| 5,555,564 A | | 9/1996 | Welch | 2/239 |
| 6,032,286 A | * | 3/2000 | Thomas et al. | 128/892 |
| 6,327,710 B1 | * | 12/2001 | Dunn et al. | 2/22 |

* cited by examiner

*Primary Examiner*—John J. Calvert
*Assistant Examiner*—Tejash Patel
(74) *Attorney, Agent, or Firm*—John F. Bryan

(57) ABSTRACT

Apparatus, particularly adapted to covering and protecting the ankles of off-road bicycle riders from injury, has an ankle-length sock made of elastic knitted fabric covering each of the rider's feet and a pair of bicycling shoes having low-cut uppers. A thin guard of a hard, flexible material passing around the rider's ankle is retained at the outside of each sock, extending from the top of the sock to a line proximate the top of the shoe upper so as to protect the inside and outside of the ankle joint.

11 Claims, 4 Drawing Sheets

PROTECTIVE ANKLE WEAR FOR BICYCLERS

TECHNICAL FIELD

The present invention relates to the field of bicycling and more particularly, to apparatus for protecting the ankles of a bicycle rider from injury.

BACKGROUND

Bicycle riding has become a favorite sport for a significant segment of the active, health conscious population. Many cycling devotees prefer variants of the sport known as off-road and mountain biking. Such riding takes place in unimproved areas where rough terrain, rocky outcroppings and underbrush may impede passage. Also, in close quarters, the inside of the rider's ankles may be forced into contact with the pedal crankshaft arms. Seasoned riders become quick to recognize hazards and skillful in avoiding them, but even the best cannot always prevent hard contact. In this manner, thinly fleshed ankles are directly exposed to point impact, and are particularly vulnerable to bruising and laceration.

There is no doubt that bicycle riders would be much safer if they wore protective boots, but there is no place in the sport for such weighty, obtrusive measures. In addition, because of the ankle joint's constant movement and flexing, chafing can make any hard protective ankle cover impractical. The chafing problem is exacerbated by heat and sweating. Although long pants might help to a limited extent, few hot weather riders would accept them as regular wear. In bicycling the legs pump constantly at a high level of effort and generate excess heat, which must be dissipated by the rider's body. Airflow over the rider's legs takes away a portion of this excess heat at the source, while the skin and lungs account for the rest. It is therefore obvious that heavy leg wear would work against the rider's needs, particularly during periods of extreme exertion.

Protective leg wear has been disclosed for certain sports activities. Giesick, U.S. Pat. No. 4,856,110 teaches use of a full-length sock, woven from aramid and metallic fibers, to protect the back of hockey player's legs against cuts and puncture wounds. Giesick also teaches that the reinforced area of the sock may be made to extend upwardly from the foot, to shield the Achilles tendon. While an aramid/metallic fiber sock would protect a bicycle rider from cuts, it would be ineffective against point impact injuries. While wearing such a sock might be comfortable on ice, it would be much less so for a bicycle rider and would impede body cooling as discussed above.

Thomeburg, et al, U.S. Pat. No. 5,307,522 discloses a cushioned sock for snowboarding. Thorneburg teaches the use of extra-heavy, fabric thickness at the medial portion of the rear of the leg, to prevent chafing against the snowboarding boot, and above the heel, to force the foot forwardly in the boot, so as to provide a firm fit and prevent shifting of the foot in the boot. Thomeburg, et al, also teach similar fabric thicknesses for cushioning the ball and heel of the foot against the impact of landing, much as seen in athletic socks for basketball and the like. None of these attributes are significant, or even helpful to a bicycle rider. As with the above aramid/metallic sock, the padded snowboarding sock of Thorneburg, et al would be ineffective against point impact injuries. A snowboarder wearing such a sock might be comfortable, but not a bicycle rider at much higher temperatures and again, body cooling would be impeded.

SUMMARY OF THE INVENTION

A first object of the present inventions is therefore, to provide effective apparatus for protecting the inside and outside of an off-road bicycle rider's ankles from bruises and cuts arising from point impact with underbrush, rocks and the like by distributing the shock over a significantly increased area. A second object is that the apparatus of the present inventions be light in weight and unobtrusive, so as to not interfere with pedaling movements. A third object is that that the apparatus of the present inventions be of a form that does not interfere significantly with cooling air flow about the legs of the user. Yet a fourth object is that the apparatus of the present inventions can be produced inexpensively so as to encourage its wide usage.

The present inventions address the foregoing objects in direct manner by providing an ankle-length sock made of elastic knitted fabric for covering each of the rider's feet and ankles and retaining a guard made of a thin, hard, flexible material, approximately one-eighth of an inch thick, at the outer surface of each sock, so as to extend from the top of the sock down to a line proximate the top of the rider's shoe uppers. The guard passes around the rider's ankle to protect the inside as well as the outside of the ankle joint.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
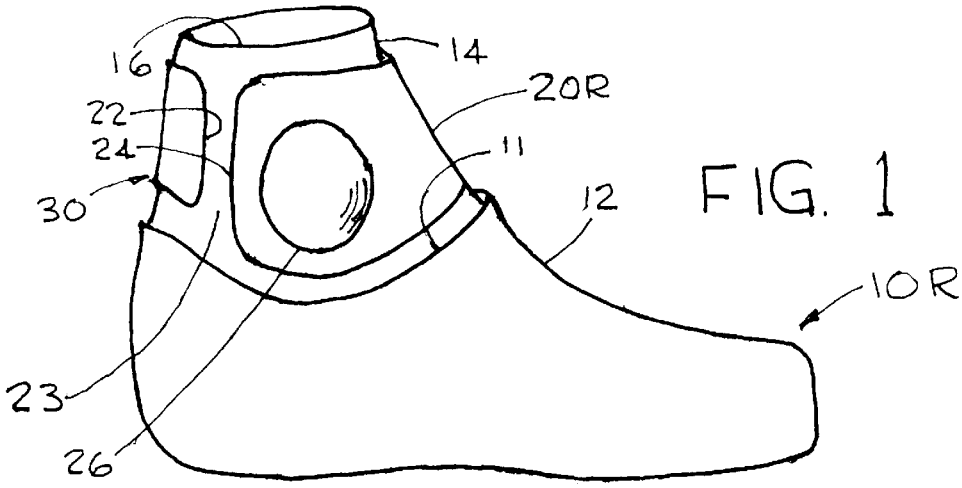
FIGS. 1 and 1A are views of a preferred embodiment of the apparatus for bicycle rider ankle protection according to the present inventions.

The present inventions are described in the following by referring to drawings of examples of how the inventions can be made and used. In these drawings, reference characters are used throughout the views to indicate like or corresponding parts. The embodiments shown and described herein are exemplary. Many details are well known in the art, and as such are neither shown nor described.

Figure 1A:
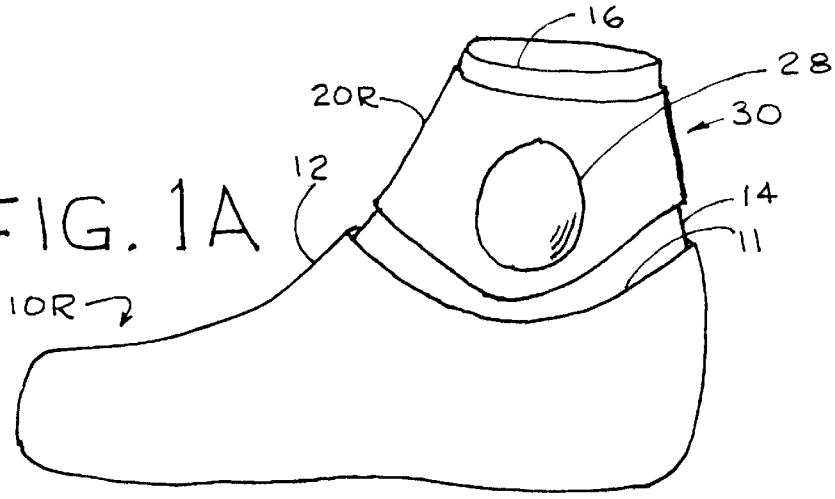

FIGS. 1 and 1A show a preferred embodiment of the elements of the present inventions in their appropriate physical relationship. FIG. 1 shows an outside view of the user's right shoe 10R and FIG. 1A shows the companion inside view of shoe 10R. Shoe 10R, with upper 12 is fitted over sock 14, which covers the user's foot and extends upwardly to sock top 16. Ankle guard 20R is made of a thin and hard, but flexible material such as leather or an appropriate plastic about one-eighth inch thick. The thickness of ankle guards' 20R & 20L can vary according to the properties of the selected material. Ankle guards' 20R & 20L are formed to wrap around the ankle portion of socks 14 in a spring-like manner, so that the ankle of a user is essentially covered from the top line 11 of shoe uppers 12 to sock top 16. Gap 23 may be allowed as shown between ends 22 and 24 of ankle guard 20R or, ends 22 and 24 may overlap. In either case, ends 22 and 24 are preferably unrestrained, so as to allow the user the necessary freedom for flexing his ankles under the protective cover of ankle guard 20R & 20L. It is notable that gap 23 is offset from heel area 30 that, as a bonus, the user's Achilles tendon is protected The more or less circular areas 26 and 28 fit at the user's outer and inner ankle joints, and are domed slightly to fit comfortably over these protrusions. This also spreads contact over a larger area to dissipate point impact loads.

Figure 2:
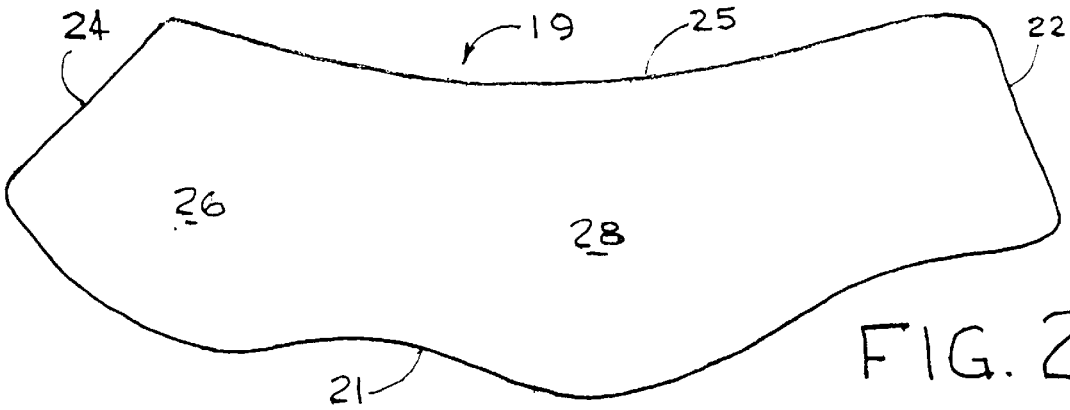
FIG. 2 is a planar view of the cutout shape of the guard of FIG. 1.

FIG. 2 shows the flat pattern 19 of ankle guards' 20R & 20L before it is formed to wrap around the user's ankle. Flat patterns 19 do not assume a right or left identity until they are formed to wrap around the user's ankle. The doming of joint contact areas 26 and 28 will take place at this same time. Note that, although end 22 is extended significantly more than end 24, so as to place gap 23 at the side of the user's ankle, the portion encompassing joint contact areas 26 and 28 is basically symmetrical. Lower edge 21 of flat pattern 19 is contoured to fit just above the top line of shoe upper 12 at the inside and outside of shoes 10R & 10L, with slightly more clearance at the tongue and heel to allow freedom in flexing the ankle. Top edge 25 of flat pattern 19 is contoured to fit around the ankle, along a substantially horizontal line above the ankle joint protrusions, of the user. To accommodate male and female users of all sizes, flat patterns 19 are provided in a range of sizes.

Figure 3:
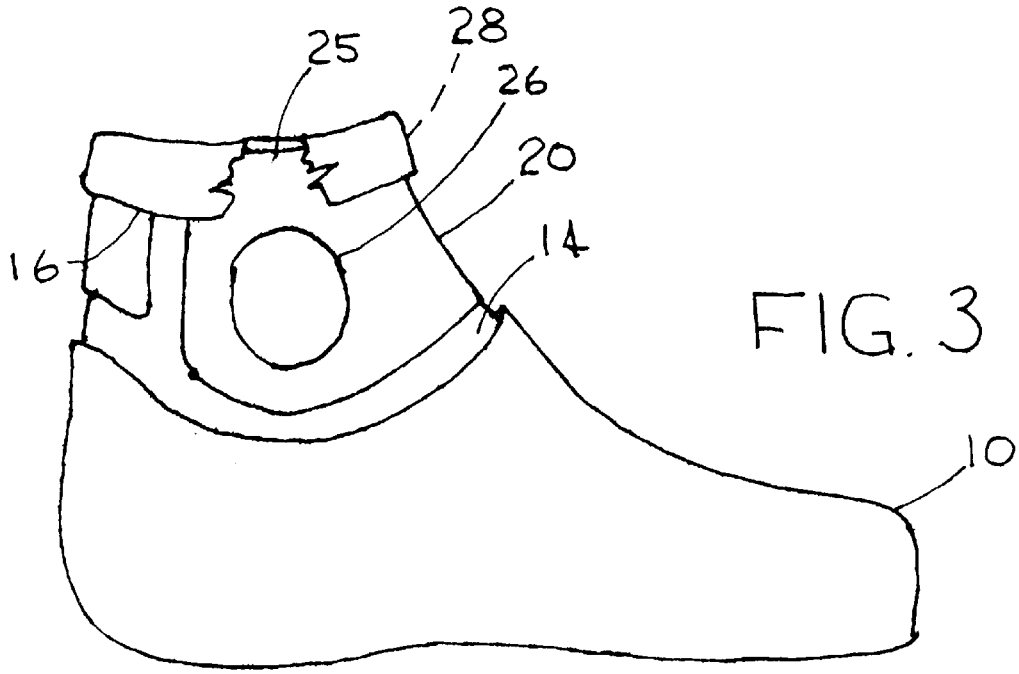
FIG. 3 is a view of a preferred retention of the guard of the present inventions.

FIG. 3 shows a preferred retention for ankle guard 20 of the present inventions. It is preferred that any relative motion take place between sock 14 and ankle guard 20 rather than between sock 14 and the ankle of the user. Here, ankle guard 20 is seen to be held in place around the ankle by its inherent spring tension and the fit of domed areas 26 and 28 over the ankle joint protrusions of the user. Ankle guard 20 is prevented from riding up as the user's ankle flexes repeatedly by turning the top 16 of sock 14 down over the top edge 25 of ankle guard 20.

Figure 4:
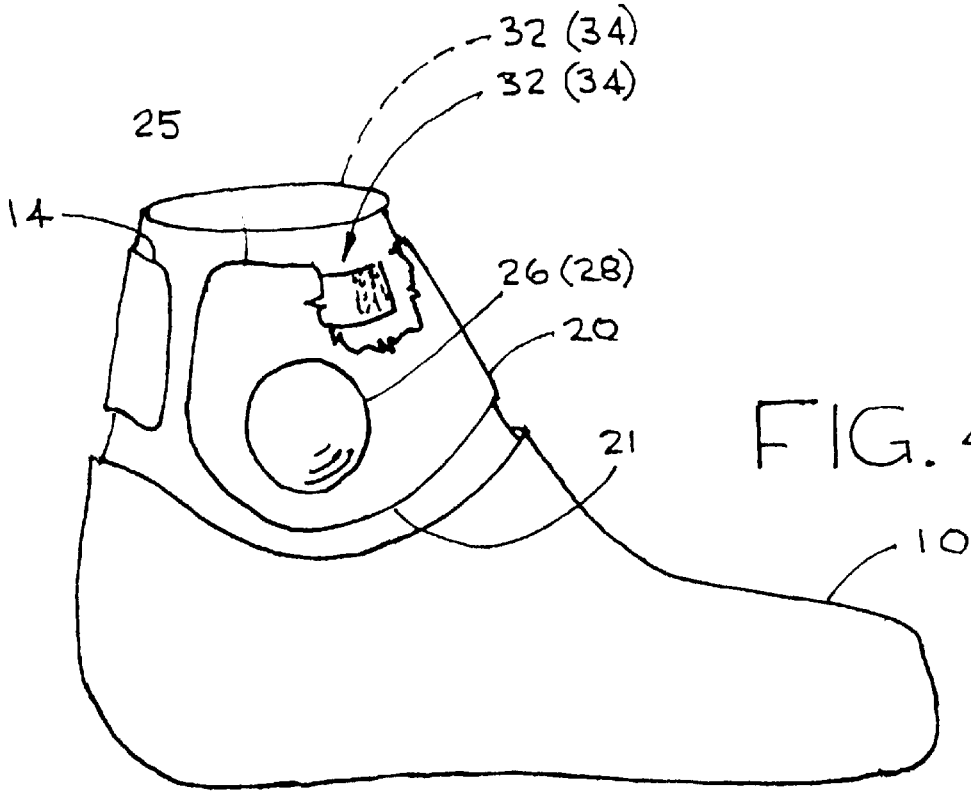
FIG. 4 is a view of a second preferred retention of the guard of the present inventions.

FIG. 4 shows yet another preferred means for retaining ankle guard 20 of the present inventions. Again, ankle guard 20 is held in place around the ankle by its inherent spring tension and the fit of domed areas 26 and 28 over the ankle joint protrusions. Here, ankle guard 20 is positively retained to sock 14 by means of adhesively attached hook and loop fasteners 32 such as available under the trade name "VELCRO". Fasteners 32 are located at two points near top edge 25 of ankle guard 20 and placed to avoid creating pressure points on thinly fleshed bony areas. In this manner, displacement of ankle guard 20 is prevented while allowing it to move relative to sock 14 at lower edge 21. In an alternative embodiment, snap fasteners 34 may be substituted for hook and loop fasteners 32. Either fastener allows ankle guard 20 to be removed from sock 14 for laundering or other purposes, which is considered to be a functional advantage.

Figure 5:
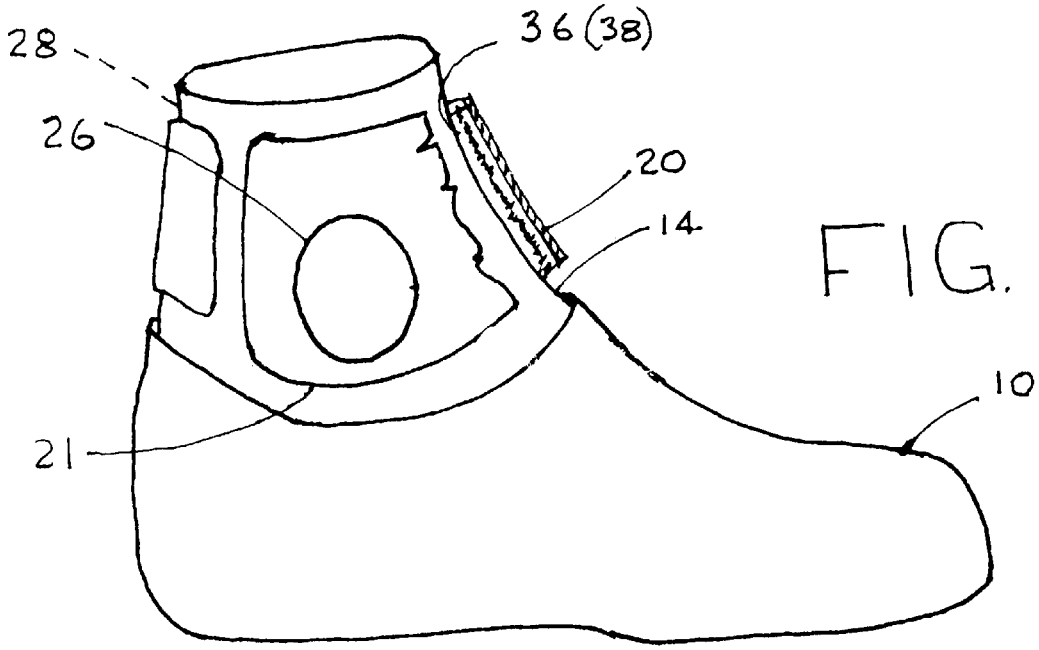
FIG. 5 is a view of a third preferred retention of the guard of the present inventions.

FIG. 5 shows a second preferred retention of ankle guard 20 of the present inventions. Again, ankle guard 20 is seen to be held in place around the ankle by its inherent spring tension and the fit of domed areas 26 and 28 over the ankle joint protrusions. Here, ankle guard 20 is attached to sock 14 by means of vertically placed hook and loop fasteners 36 or snap fasteners (38) at the front of the ankle. In an alternative embodiment, a vertical seam may be used to attach ankle guard 20 to sock 14 at the same location, albeit at the sacrifice of removability. In this manner, displacement of ankle guard 20 is prevented while allowing it to have minor movement relative to sock 14.

Figure 6:
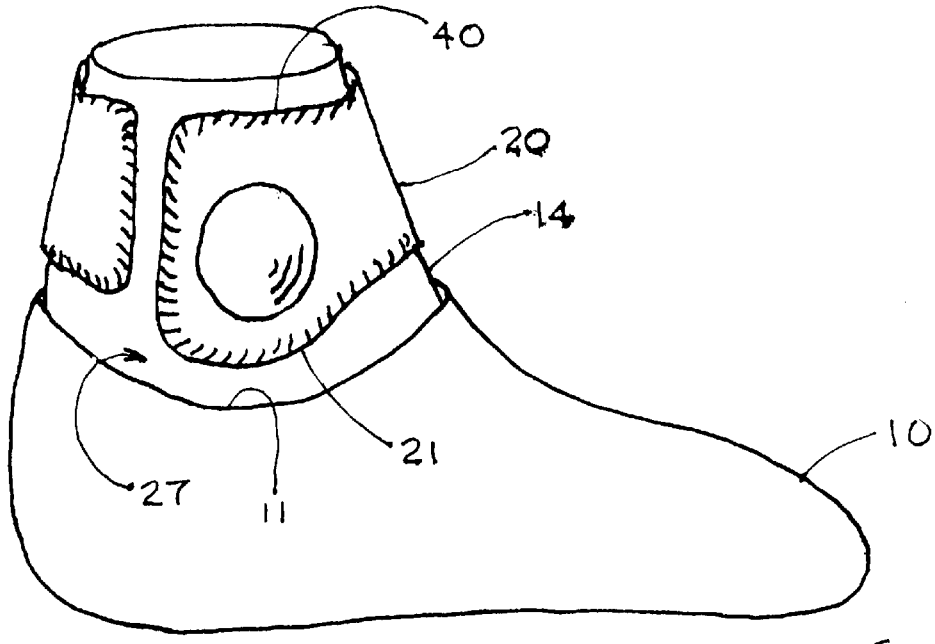
FIG. 6 is a view of a fourth preferred retention of the guard of the present inventions.

FIG. 6 shows yet another preferred retention of ankle guard 20 of the present inventions, a method perhaps rendered somewhat less desirable by its permanence. Then again, if ankle guard 20 is made from a plastic material impervious to hot water and drying machine temperatures, that is not so much of a disadvantage. As before, ankle guard 20 is seen to be held in place around the ankle by its inherent spring tension and the fit of domed areas 26 and 28 on the ankle joint protrusions. Here, ankle guard 20 is attached to sock 14 by means of continuous peripheral seam 40, again at the sacrifice of removability. In this mode of retention, it is preferable to leave a wider gap between shoe upper top line 11, and the bottom edge 21 of guard 20 so that a broader band 27 of sock 14 fabric is provided to accommodate flexing movement of the user's ankle relative to guard 20. Broader band 27 thus aids in discouraging relative movement between ankle guard 20, or sock 14, and the ankle of the user.

Figure 7:
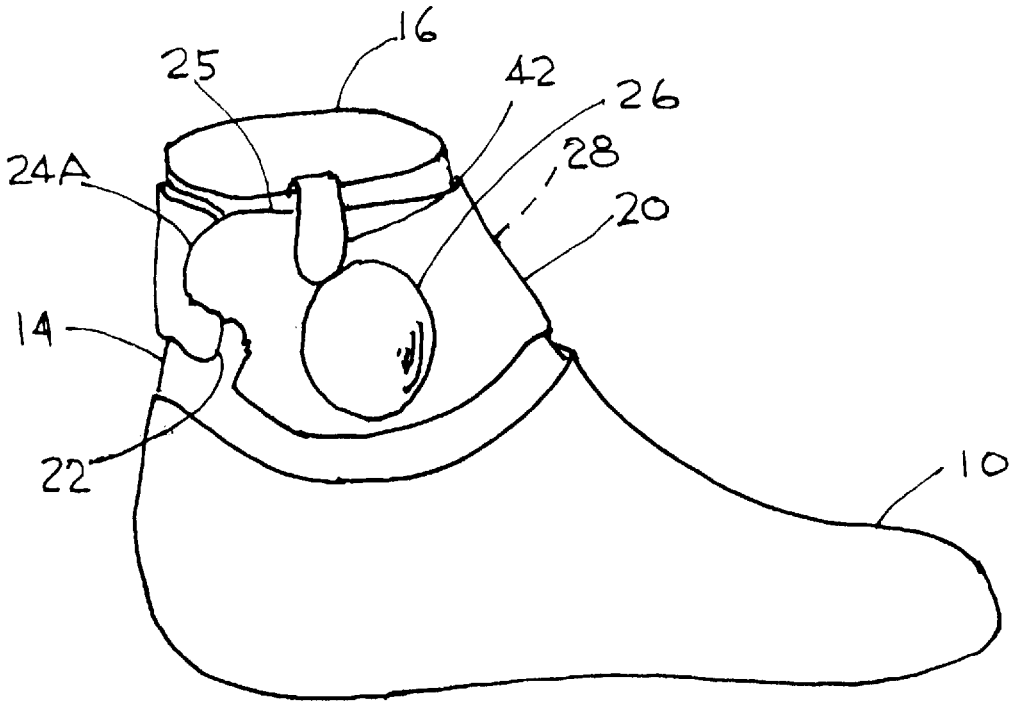
FIG. 7 is a view of a fifth preferred retention of the guard of the present inventions.

FIG. 7, in a manner somewhat similar to FIG. 3 shows an alternative retention for ankle guard 20 of the present inventions. As previously discussed, it is preferred that any relative motion take place between sock 14 and ankle guard 20 rather than between sock 14 and the ankle of the user. As before, ankle guard 20 is held in place around the ankle by its inherent spring tension and the fit of domed areas 26 and 28 over the ankle joint protrusions of the user. Ankle guard 20 is prevented from riding up as the user's ankle flexes repeatedly by clipping the top edge 25 of ankle guard 20 to the top 16 of sock 14, with one or more spring clips 42, which may include gripping teeth on their opposed inner surfaces. Also shown, is an alternative configuration of ankle guard 20 wherein end 24A is extended to overlap end 22 in a manner that does not restrict flexing of the ankle.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus used for covering and protecting the ankles and ankle joint protrusions of off-road bicycle riders from injury, comprising:

a short, ankle-length sock made of an elastic, knitted fabric for covering each of the rider feet and ankles, each sock extending from the rider foot to terminate in an ankle encircling top;

a pair of bicycling shoes having low-cut uppers for wearing over the socks; and a thin, hard, one-piece guard of light-weight, flexible material, retained over each sock and substantially encircling the ankle, while extending from proximate the top of the sock to proximate the shoe upper when worn by the user.

2. The apparatus used for covering and protecting the ankles of a rider according to claim 1 wherein the flexible guard includes domed portions located to fit over the ankle joint protrusions of the user so as to enhance retention of the guard.

3. The apparatus used for covering and protecting the ankles of a rider according to claim 2 wherein the top of the sock extends above the guard and is folded down over the guard, so as to enhance retention thereof.

4. The apparatus used for covering and protecting the ankles of a rider according to claim 2 and further comprising:

a separable hook and loop strip adhesively attaching the sock to the guard, so as to enhance retention thereof.

5. The apparatus used for covering and protecting the ankles of a rider according to claim 2 and further comprising:

a seam of stitches mutually attaching the sock to the guard, so as to enhance retention thereof.

6. The apparatus used for covering and protecting the ankles of a rider according to claim 2 and further comprising:

at least one spring clip attaching the sock to the guard, so as to enhance retention thereof.

7. A method for covering and protecting the ankle joint protrusions of off-road bicycle riders from injury, comprising the steps of:

covering each of the rider's feet and ankles with a short, ankle-length sock made of elastic knitted fabric, each sock extending upwardly from the foot to terminate in an ankle encircling top;

covering the rider's feet and socks with bicycling shoes having low-cut uppers; and substantially encircling each of the rider's ankles with a thin, hard, one piece guard of lightweight, flexible material, cupped over the ankle joint protrusions, outside of each sock and passing therearound, so as to extend from proximate the top of the sock to proximate the shoe upper.

8. The method for covering and protecting the ankle joint protrusions of a rider according to claim 7 and further including the steps of:

extending the tops of the socks above the guards; and folding the sock tops down over the guard, so as to enhance retention thereof.

9. The method for covering and protecting the ankle joint protrusions of a rider according to claim 7 and further including the steps of:

adhesively attaching separable hook and loop strips to the sock and to the guard; and engaging the hook and loop strips so as to enhance retention of the guard.

10. The method for covering and protecting the ankle joint protrusions of a rider according to claim 7 and further including the step of:

attaching the sock to the guard with a seam of stitches, so as to enhance retention of the guard.

11. The method for covering and protecting the ankle joint protrusions of a rider according to claim 7 and further including the step of:

attaching the sock to the guard with at least one spring clip, so as to enhance retention of the guard.

* * * * *